US010974372B2

(12) United States Patent
Tejima et al.

(10) Patent No.: US 10,974,372 B2
(45) Date of Patent: Apr. 13, 2021

(54) IMPACT TOOL

(71) Applicant: MAKITA CORPORATION, Anjo (JP)

(72) Inventors: Haruki Tejima, Anjo (JP); Tomoyuki Kondo, Anjo (JP); Kenji Abe, Anjo (JP); Koji Tsukamoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 181 days.

(21) Appl. No.: 16/251,425

(22) Filed: Jan. 18, 2019

(65) Prior Publication Data

US 2019/0262978 A1 Aug. 29, 2019

(30) Foreign Application Priority Data

Feb. 23, 2018 (JP) ..... JP2018-031173

(51) Int. Cl.
*B25B 21/02* (2006.01)
*B25B 19/00* (2006.01)

(52) U.S. Cl.
CPC ..... *B25B 21/026* (2013.01); *B25B 19/00* (2013.01)

(58) Field of Classification Search
CPC ..... B25B 19/00; B25B 21/026; B25B 21/02
See application file for complete search history.

(56) References Cited

U.S. PATENT DOCUMENTS 3,208,569 A * 9/1965 Adee ..... B25B 21/026 173/93
3,606,931 A * 9/1971 Karden ..... B25B 21/026 173/93.5
6,508,315 B1 * 1/2003 Lindsay ..... B25D 9/26 173/115
7,784,561 B2 * 8/2010 Lim ..... E21B 4/14 173/14
2009/0223690 A1 * 9/2009 Sugimoto ..... B25B 21/026 173/48

(Continued)

FOREIGN PATENT DOCUMENTS

CN 104044117 A 9/2014 ..... B25D 11/04
CN 104044118 A 9/2014 ..... B25D 11/06

(Continued)

OTHER PUBLICATIONS

Unpublished U.S. Appl. No. 16/491,731.

(Continued)

*Primary Examiner* — Andrew M Tecco
*Assistant Examiner* — Nicholas E Igbokwe
(74) *Attorney, Agent, or Firm* — J-Tek Law PLLC; Jeffrey D. Tekanic; Mark A. Ussai

(57) ABSTRACT

An impact driver includes a hammer that is rotated by a motor and an anvil configured to be struck by the hammer to rotate the anvil about a rotational axis. A hammer case houses the hammer. Two or more bearings are provided inside the hammer case and support the anvil. To inhibit vibration of the anvil during operation, the bearings may be differing types, such as a regular ball bearing and an angular contact ball bearing, and/or the bearings may have different inner and/or outer diameters. A contact member, such as an O-ring, may be disposed in an insertion hole of the anvil to reduce vibrations that are transmitted to the tool bit.

20 Claims, 11 Drawing Sheets

(56) References Cited

U.S. PATENT DOCUMENTS

| | | | | |
|---|---|---|---|---|
| 2009/0242222 | A1* | 10/2009 | Nagasaka | B25B 21/02 173/93 |
| 2009/0309316 | A1 | 12/2009 | Hu | |
| 2014/0262396 | A1 | 9/2014 | McClung | |
| 2014/0274526 | A1 | 9/2014 | McClung | |
| 2015/0364972 | A1 | 12/2015 | Ito | |
| 2016/0375565 | A1 | 12/2016 | Koch | B25B 23/10 |
| 2017/0165817 | A1* | 6/2017 | Vogt | B25B 21/026 |

FOREIGN PATENT DOCUMENTS

| | | | | |
|---|---|---|---|---|
| CN | 205184693 | U | 4/2016 | B25F 5/00 |
| JP | S56160769 | U | 11/1981 | B25B 23/00 |
| JP | S58160774 | A | 9/1983 | |
| JP | H09117870 | A | 5/1997 | |
| JP | 2001054874 | A | 2/2001 | |
| JP | 3146887 | B2 | 3/2001 | |
| JP | 2010046787 | A | 3/2010 | B25B 21/00 |
| JP | 2011083868 | A | 4/2011 | |
| JP | 2016107375 | A | 6/2016 | |
| JP | 2016215373 | A | 12/2016 | |
| TW | 200950938 | A | 12/2009 | B25B 27/06 |
| WO | 2018163561 | A1 | 9/2018 | |

OTHER PUBLICATIONS

Office Action and Search Report from the Chinese Patent Office dated Sep. 27, 2020 in related Chinese application No. CN 201780087815, and machine translation thereof.

Third Party Submission dated Jan. 18, 2021 in counterpart Japanese application No. JP2018-031173, and machine translation thereof.

* cited by examiner

| MEASUREMENT RESULTS | HEX GAGE DIMENSION | | | |
|---|---|---|---|---|
| | 6.35 + 0.00/-0.01 | 6.37 + 0.00/-0.01 | 6.39 + 0.00/-0.01 | 6.41 + 0.00/-0.01 |
| COMPANY A | FULLY INSERTABLE | NOT INSERTABLE BEYOND 9.0 mm FROM THE OPENING | NOT INSERTABLE INTO THE OPENING | NOT INSERTABLE INTO THE OPENING |
| COMPANY B | FULLY INSERTABLE | NOT INSERTABLE BEYOND 5.5 mm FROM THE OPENING | NOT INSERTABLE INTO THE OPENING | NOT INSERTABLE INTO THE OPENING |
| COMPANY C | FULLY INSERTABLE | NOT INSERTABLE BEYOND 5.5 mm FROM THE OPENING | NOT INSERTABLE INTO THE OPENING | NOT INSERTABLE INTO THE OPENING |
| COMPANY D | FULLY INSERTABLE | FULLY INSERTABLE | NOT INSERTABLE INTO THE OPENING | NOT INSERTABLE INTO THE OPENING |
| COMPANY E | FULLY INSERTABLE | FULLY INSERTABLE | NOT INSERTABLE BEYOND 9.0 mm FROM THE OPENING | NOT INSERTABLE INTO THE OPENING |
| COMPANY F | FULLY INSERTABLE | FULLY INSERTABLE | NOT FULLY INSERTABLE | NOT INSERTABLE INTO THE OPENING |
| COMPANY G | FULLY INSERTABLE | FULLY INSERTABLE | NOT INSERTABLE BEYOND 11.0 mm FROM THE OPENING | NOT INSERTABLE INTO THE OPENING |

FIG.10

IMPACT TOOL

The present application claims priority to Japanese patent application serial number 2018-031173 filed on Feb. 23, 2018, the contents of which are incorporated fully herein by reference.

TECHNICAL FIELD

The present invention relates to an impact tool, such as an impact driver, comprising an anvil that is struck in a rotational direction.

BACKGROUND ART

In the impact driver shown in Japanese Laid-open Patent Publication 2016-107375, a hammer is coupled, via balls, to a spindle, and the rotation of a motor is transmitted thereto. A rotational-impact force (impact) is intermittently generated by the repeating engagement (owing to a coil spring externally mounted on the spindle) of a hammer with an anvil (which constitutes an output shaft onto which a bit is mounted), and disengagement of the hammer from the anvil as the torque applied to the anvil increases.

SUMMARY OF THE INVENTION

In the known impact tool described above, the anvil is axially supported in a case (e.g., a hammer case) by a bearing (e.g., a needle bearing). However, because a clearance arises in the structure between the bearing and the anvil during operation, the anvil rattles during rotation, thus causing the bit at the tip of the anvil to vibrate.

Accordingly, it is one non-limiting object of the present invention to provide an impact tool in which vibration of the bit can be inhibited (reduced).

In one aspect of the present teachings, an impact tool, such as an impact driver, preferably comprises: a motor; a hammer that is rotated by the motor; an anvil that is struck by the hammer in a rotational direction; a hammer case that houses the hammer; and two or more bearings that are provided inside the hammer case and rotatably support the anvil. The bearings are preferably of differing types, such as, e.g., regular ball bearing, angular contact ball bearing, self-aligning ball bearing, plain bearing (plain bushing), etc.

The bearings (e.g., the rings (races) and/or rolling elements thereof) may have differing inner diameters and/or differing outer diameters and/or different rolling element diameters.

In addition or in the alternative, the bearings may be held by the hammer case or the anvil.

In another aspect of the present teachings, an impact tool, such as an impact driver, preferably comprises: a motor; a hammer that is rotated by the motor; an anvil that is struck by the hammer in the rotational direction and has an insertion hole, which has a regular hexagonal shape in transverse cross section and into which a bit is inserted; and a hammer case that houses the hammer. On an inner surface of the insertion hole, a spacing between mutually (diametrically) opposing flats is set to a dimension such that a hex gage whose across-flats-distance dimension is 6.35-6.34 mm is fully insertable into the insertion hole, and a hex gage whose across-flats-distance dimension is 6.37-6.36 mm is insertable only up to a location (depth) that is less than 5.4 mm from the opening of the insertion hole toward the far (bottom) side of the insertion hole.

In addition, the spacing between the mutually (diametrically) opposing flats may be set to a dimension such that a hex gage whose across-flats-distance dimension is 6.39-6.38 mm is not insertable through the opening of the insertion hole.

In another aspect of the present teachings, an impact tool, such as an impact driver, preferably comprises: a motor; a hammer that is rotated by the motor; an anvil that is struck by the hammer in the rotational direction and has a ball that holds a bit inside an insertion hole, which has a regular hexagonal shape in transverse cross section and into which the bit is inserted; and a hammer case that houses the hammer. A contact member is disposed inside the insertion hole and abuts the inserted bit from (in) a radial direction or an axial direction.

Preferably, the contact member is an elastic body.

In addition, it is expressly note that the above-mentioned aspects and preferable modifications may be combined in various additional ways that are not explicitly mentioned in order to provide additional aspects and embodiments of the present teachings.

According to embodiments of the present teachings, rattling of an anvil can be effectively reduced, and vibration of a tip bit can be inhibited (reduced).

Additional objects, embodiments, effects and advantages of the present teachings will be readily apparent to a person skilled in the art after reading the following description and claims in view of the appended drawings.

BRIEF DESCRIPTION OF THE DRAWINGS

FIG. 10 is a table that shows the results of an investigation with regard to hex gages having differing across-flats-distance dimensions, which were inserted into the anvils of commercially available impact tools.

DETAILED DESCRIPTION OF THE EMBODIMENTS

Representative, non-limiting embodiments of the present teachings will now be explained in detail below, with reference to the drawings.

Figure 1:
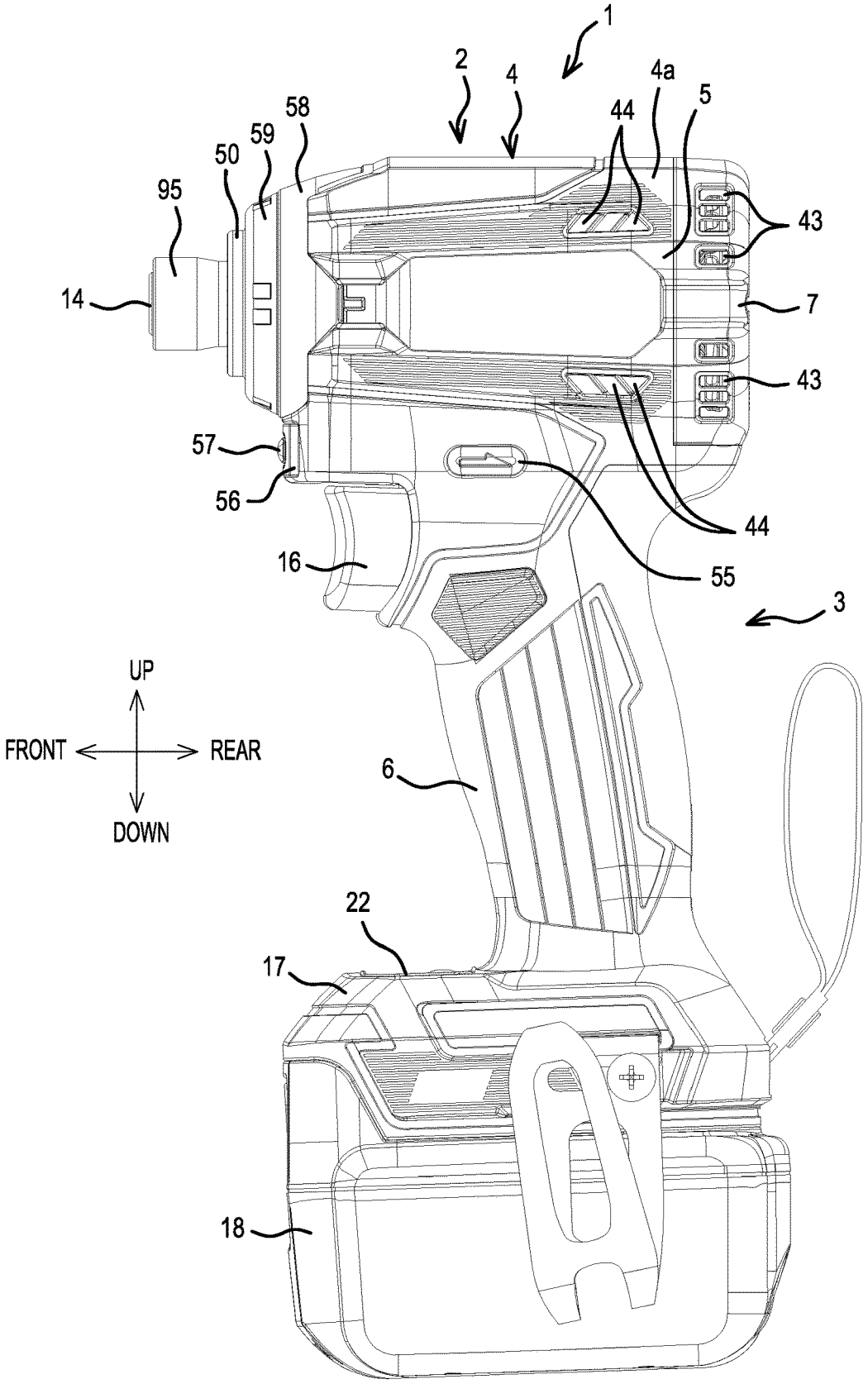
FIG. 1 is a side view of a first representative, non-limiting impact driver according to the present teachings.
Figure 2:
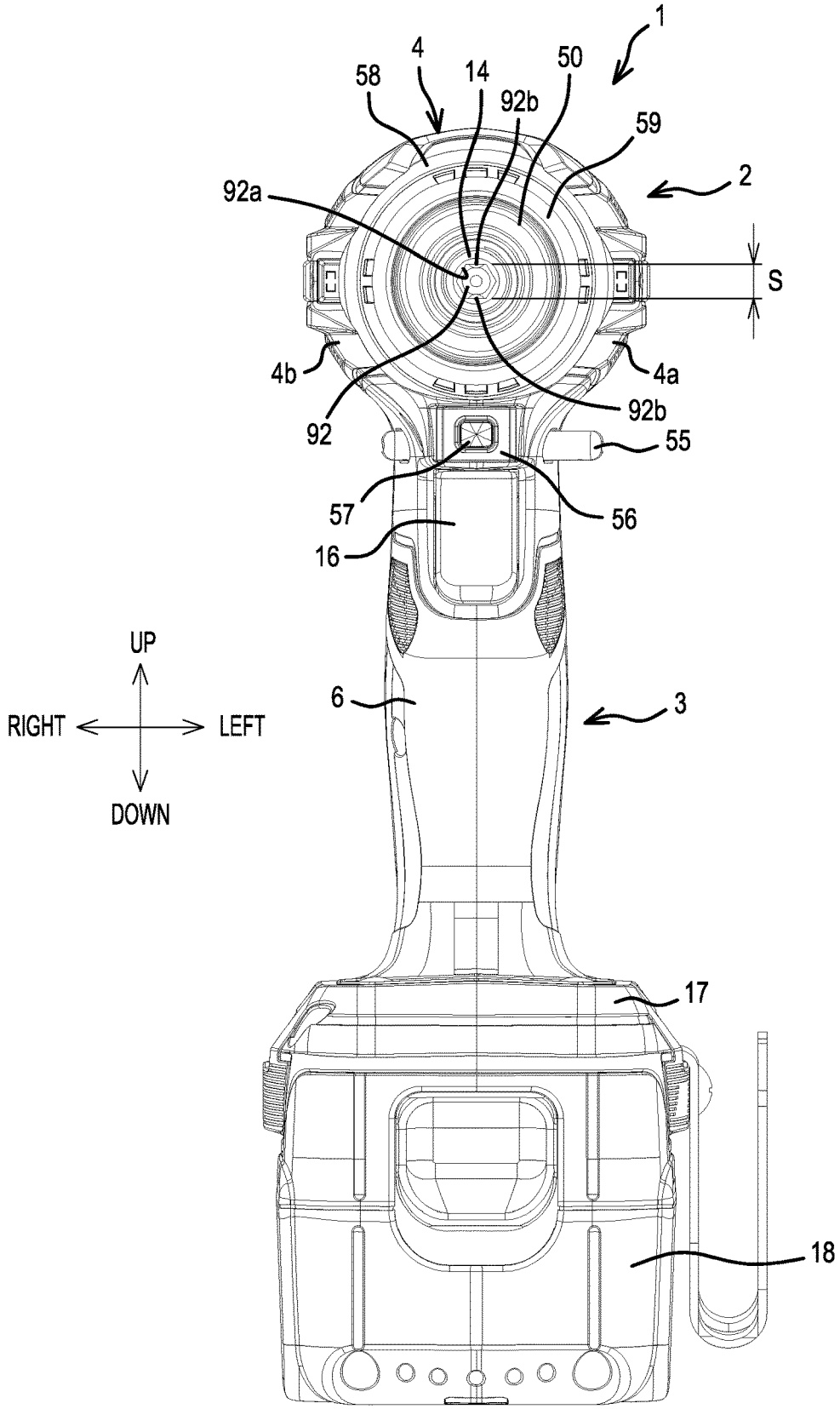
FIG. 2 is a front view of the impact driver of FIG. 1.

Referring first to FIGS. 1 and 2, an impact driver 1 of a first embodiment of the present teachings comprises: a main-body part 2, whose central axis extends in a front-rear direction; and a grip part 3, which protrudes downward from the main-body part 2. A housing of the impact driver 1 comprises: a main-body housing 4, in which a tube-shaped motor housing 5 that forms part of the main-body part 2 and a grip housing 6 that forms part of the grip part 3 are contiguously coupled; a rear cover 7, which is screw-fastened on a rear end of the motor housing 5; and a hammer case 8, which is joined to a front part of the motor housing 5. The main-body housing 4 is divided into left and right half housings 4*a*, 4*b*, which are joined together by screws 9 in the left-right direction.

Figure 3:
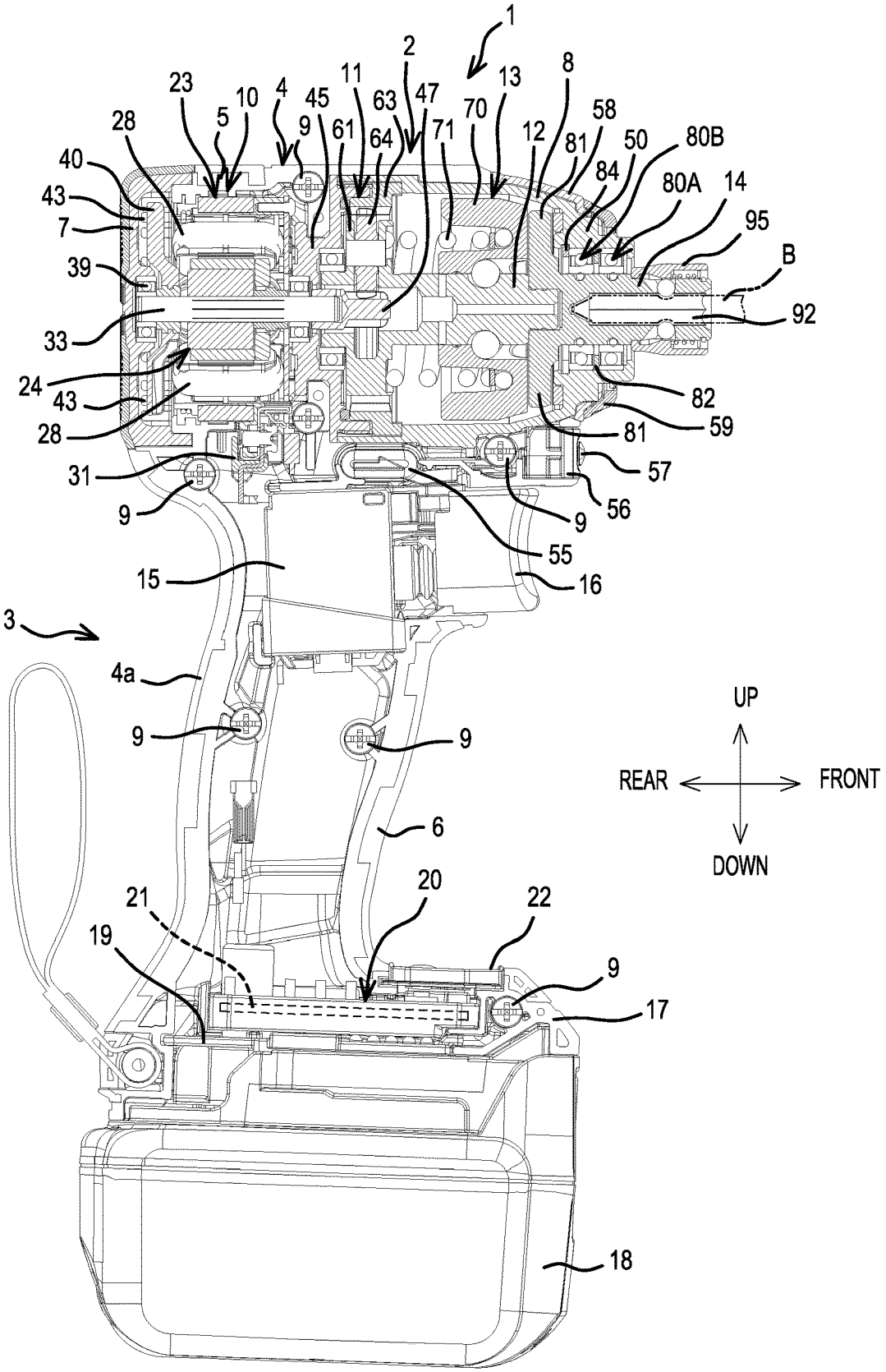
FIG. 3 is a center, longitudinal, cross-sectional view of the impact driver of FIG. 1.

As shown in FIG. 3, a motor 10, a planetary-gear, speed-reducing mechanism 11, a spindle 12, and an impact mechanism 13 are provided, in order from the rear, in the main-body part 2. In the motor housing 5 of the motor 10, the planetary-gear, speed-reducing mechanism 11, the spindle 12, and the impact mechanism 13 are each housed in the hammer case 8. An anvil 14, which is provided on the impact mechanism 13 and constitutes an output shaft, protrudes forward from a front end of the hammer case 8.

A switch 15, from which a trigger 16 protrudes forward, is housed in an upper part of the grip part 3. A battery-mount part 17, on which a battery pack 18 (i.e. a rechargeable power supply) is mounted, is formed on a lower end of the grip part 3. A terminal block 19, which is electrically connected to the battery pack 18, and a controller 20, which is located thereabove, are housed inside the battery-mount part 17. A control circuit board 21, on which a microcontroller, a switching device, etc. are installed, is provided on the controller 20. A display panel 22, which is electrically connected to the control circuit board 21 and displays the rotational speed of the motor 10, the remaining charge of the battery pack 18, and the like, is provided on an upper surface of the battery-mount part 17.

Figure 4:
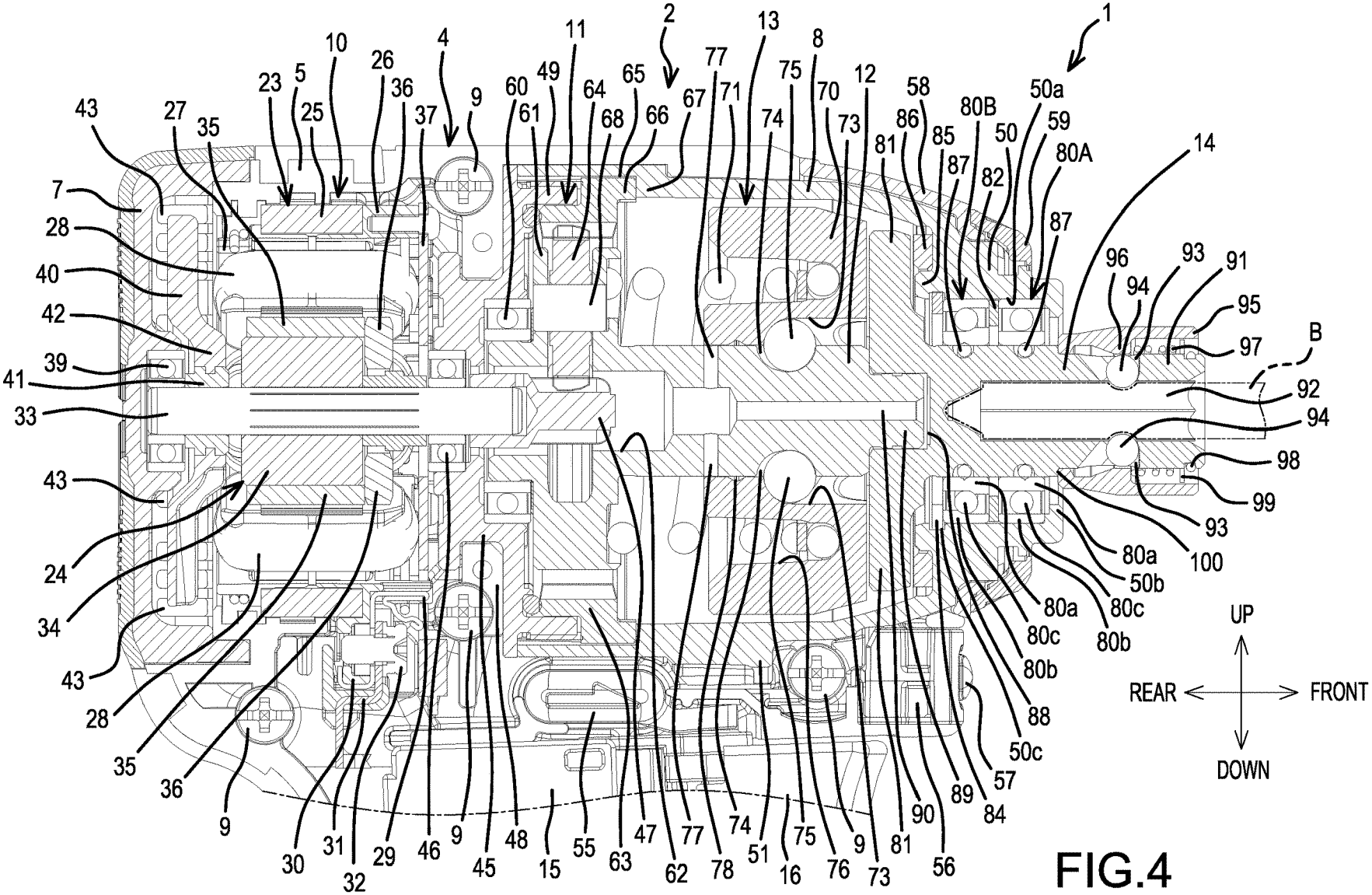
FIG. 4 is an enlarged cross-sectional view of a main-body part of the impact driver of FIG. 1.

Referring now to FIGS. 3 and 4, the motor 10 is an inner-rotor type brushless motor that comprises a stator 23 and a rotor 24. Preferably, the stator 23 comprises: a stator core 25, which is formed by laminating (stacking) a plurality of steel plates; a front insulating member 26 and a rear insulating member 27, which are provided frontward and rearward of the stator core 25; and a plurality of coils 28, each being wound around the stator core 25 and through the front insulating member 26 and the rear insulating member 27. The stator 23 is held inside the motor housing 5. Three fusing terminals 29 are provided on the front insulating member 26. One end of each fusing terminal 29 sandwiches and fuses a wire of the coils 28. The other end of each fusing terminal 29 is routed to a coupling piece 30, which protrudes downward from a lower end of the front insulating member 26. A terminal unit 31 has a U shape in side view, and is wired from the controller 20. Lead wires corresponding to the fusing terminals 29 are soldered to the terminal unit 31. Furthermore, the terminal unit 31 is joined to the coupling piece 30 from below by a screw 32 such that the terminal unit 31 is pinched by the coupling piece 30 and thereby electrically connected thereto. A three-phase power-supply line, which is routed from the terminal unit 31, passes rearward of the switch 15 through the interior of the grip part 3 and is connected to the control circuit board 21 inside the controller 20.

The rotor 24 comprises: a rotary shaft 33, which is located at the axial center; a tube-shaped rotor core 34, which is disposed around the rotary shaft 33; permanent magnets 35, which are disposed on an outer side of the rotor core 34, which are tube shaped, and whose polarities alternate in the circumferential direction; and a plurality of sensor permanent magnets 36, which is disposed radially on a front side of the permanent magnets 35. A sensor circuit board 37, which detects the positions of the sensor permanent magnets 36 of the rotor 24 and on which three rotation-detection devices that output rotation-detection signals are mounted, is fixed by a screw to a front end of the front insulating member 26. Signal lines for outputting the rotation-detection signals are connected to a lower end of the sensor circuit board 37. These signal lines also pass rearward of the switch 15 through the interior of the grip part 3 and are connected to the control circuit board 21 inside the controller 20, in the same manner as the power-supply lines.

The rear cover 7 is attached to the rear of the motor housing 5 by left and right screws (not shown) and has a cap shape. A bearing 39 is held by the rear cover 7 and axially supports a rear end of the rotary shaft 33. A centrifugal fan 40 for cooling the motor is attached forward of the bearing 39 to the rotary shaft 33 via a metal insert bushing 41. A center part of the centrifugal fan 40 is shaped as a flared part 42, which flares forward in a bowl shape. The bearing 39 is disposed such that it overlaps the centrifugal fan 40 in a radial direction on the immediate rear side of the flared part 42. Air-exhaust ports 43, which are located radially outward of the centrifugal fan 40, are formed in side surfaces of the rear cover 7, and air-suction ports 44 are formed in side surfaces of the motor housing 5.

On the other side of the motor 10, a front end of the rotary shaft 33 is inserted through a bearing retainer 45, which is forward of the motor 10 and held by the motor housing 5, and protrudes forward. The front end of the rotary shaft 33 is axially supported by a bearing 46, which is held by a rear part of the bearing retainer 45. A pinion 47 is mounted on a front end of the rotary shaft 33.

The bearing retainer 45 is made of metal and has a disc shape. The center of the bearing retainer 45 is formed into a neck part. By mating a rib 48, which is provided on an inner surface of the motor housing 5, in the neck part, the bearing retainer 45 is held by the motor housing 5 such that movement of the bearing retainer 45 is restricted (blocked) in the front-rear direction.

In addition, a ring wall 49, on which a male thread is formed on the outer circumference, is provided on a peripheral edge of the front surface of the bearing retainer 45 such that it projects forward. A part having a female thread is provided on a rear-end inner circumference of the hammer case 8 and is coupled to (threaded or screwed onto) the ring wall 49.

The hammer case 8 is a metal tubular body. A front half of the hammer case 8 is tapered and a front tube 50 is formed at a front end. A rear half of the hammer case 8 is closed up by the bearing retainer 45, which constitutes a cover. A projection 51 is formed on a lower surface of the hammer case 8. In the assembled state, presser ribs (not shown), which project from the inner surfaces of the left and right half housings 4*a*, 4*b*, make contact with side surfaces of the projection 51.

In addition, ridges, which extend in the front-rear direction and have an oblong shape in side view, are formed on the left and right side surfaces of the hammer cases 8. Similarly shaped recessed grooves are formed on the inner surfaces of the half housings 4*a*, 4*b*. These ridges and the recessed grooves (not shown) mate with one another. Rotation of the hammer case 8 is restricted (blocked) by the engagement of the projection 51 and the presser ribs as well as by the engagement of the ridges and the recessed grooves.

A forward/reverse switching lever 55 of the motor 10 is provided on the main-body housing 4 between the hammer case 8 and the switch 15 such that the forward/reverse switching lever 55 can slide left and right. Forward thereof, a switch 56, which is capable of switching the impact mode, is held on the main-body housing 4 in a forward-facing attitude such that a button 57 is exposed on the front surface. The button 57 is operable by pressing it with a finger that grips the grip part 3. Here, by repetitively pushing the button 57, the impact force is switched in four stages, namely "low," "medium," "high," and "maximum."

In addition, a translucent resin hammer-case cover 58 covers the front tube 50 of the hammer case 8 from the front part of the hammer case 8 and is provided forward of the motor housing 5. A rubber bumper 59 is mounted on a front-end, outer-circumference part of the hammer-case cover 58.

Furthermore, a bearing 60 is held by the front part of the bearing retainer 45, and a rear end of the spindle 12 is axially supported by the bearing 60. The spindle 12 comprises a disc-shaped carrier 61, the rear part of which is hollow. The front end of the rotary shaft 33 and the pinion 47 protrude into the interior of a bottomed hole (blind hole) 62, which is formed (extends) from a rear surface along the axial center.

The planetary-gear, speed-reducing mechanism 11 comprises an internal gear 63, which has internal teeth, and three planet gears 64, which have external teeth that mesh with the internal gear 63. The internal gear 63 is coaxially housed on the inner side of the ring wall 49 of the bearing retainer 45. On the front-part, outer-circumferential side thereof, a rotation-stop part 66, which engages with a recessed part 65 formed forward of the female thread, is provided at an inner-circumferential surface of the hammer case 8. Because the rotation-stop part 66 is pinched between the ring wall 49 and a step 67, which is provided on the inner-circumferential surface of the hammer case 8, movement in the axial direction is also restricted. The planet gears 64 are rotatably supported by respective pins 68 inside the carrier 61 of the spindle 12 and mesh with the pinion 47 of the rotary shaft 33.

The impact mechanism 13 comprises a hammer 70, which is externally mounted on the spindle 12, and a coil spring 71, which biases the hammer 70 forward. Preferably, the hammer 70 comprises a pair of tabs (not shown) on its front surface and couples with the spindle 12 via balls 75, which extend over and mate with outer-side cam grooves 73 formed on an inner surface. Inner-side cam grooves 74 are formed on a surface of the spindle 12. In addition, a ring-shaped groove 76 is formed on a rear surface of the hammer 70; a front end of the coil spring 71 is inserted therein. A rear end of the coil spring 71 makes contact with a front surface of the carrier 61. A ring-shaped recessed groove 78 communicates with communication holes 77, which are formed such that they pass through in radial directions from the bottomed hole 62 of the spindle 12 at a retracted position during an impact operation. The ring-shaped recessed groove 78 is formed on an inner circumference of the hammer 70. Lubrication between the hammer 70 and the spindle 12 is achieved by supplying grease inside the bottomed hole 62 to the recessed groove 78 via the communication holes 77.

The anvil 14 is axially (and rotatably) supported by two (front and rear) bearings 80A, 80B, which are held inside the front tube 50 of the hammer case 8. In the present embodiment, bearings of differing types are used. For example, the bearing 80A on the front side may be a regular ball bearing, and the bearing 80B on the rear side may be an angular contact ball bearing. Two arms 81, which engage with the tabs of the hammer 70 in the rotational direction, are formed on a rear end of the anvil 14. Each of the front and rear bearings 80A, 80B comprises an inner ring 80*a*, an outer ring 80*b*, and a plurality of balls 80*c* disposed in a row in the circumferential direction between the inner and outer rings 80*a*, 80*b*. However, in the angular contact ball bearing 80B, the straight lines that connect the contact points between the balls 80*c* and the inner rings 80*a* as well as the balls 80*c* and the outer rings 80*b* are tilted from the axis line such that they form a prescribed angle (contact angle).

In addition, an intermediate washer 82 is interposed between the front and rear bearings 80A, 80B. Because the intermediate washer 82 contacts the outer rings 80*b*, 80*b* of the bearings 80A, 80B, a prescribed spacing is maintained between the bearings 80A, 80B.

In the present embodiment, the bearings 80A, 80B and the intermediate washer 82 have the same outer diameter and are inserted, from the rear, into an inner-diameter part 50*a* of the front tube 50, the diameter of which is constant from front to rear. A ring-shaped positioning part 50*b*, the diameter of which is smaller than that of the inner-diameter part 50*a*, is provided around a front end of the front-tube part 50 and is positioned forward of the outer ring 80*b* because the outer ring 80*b* of the front-side bearing 80A contacts the positioning part 50*b*. Inside the front tube 50, a rear washer 84, which is for positioning the bearing 80B rearward, is provided rearward of the rear side bearing 80B. The rear washer 84 has an outer diameter that is larger than the outer diameter of the bearing 80B and of the inner-diameter part 50*a*. The rear washer 84 mates with a groove 50*c*, which is provided on an inner-circumferential surface of the front-tube part 50 and extends in the circumferential direction, and makes contact with the outer ring 80*b* of the bearing 80B.

In addition, a ring-shaped holder 85, whose inner diameter is smaller than the outer diameter of the rear washer 84 and whose outer diameter is larger than the outer diameter of the rear washer 84, is coaxially provided forward of the arms 81 such that it protrudes from a rear-surface inner circumference side of the front tube 50. A thick resin outer washer 86, whose rear surface is located rearward of the holder 85, mates with an outer side of the holder 85. The outer washer 86 receives the arms 81.

Furthermore, two O-rings 87 are provided between the respective inner sides of the bearings 80A, 80B (i.e., one on the front and one on the rear) and the anvil 14 so as to respectively contact the inner rings 80*a*, 80*a* of the bearings 80A, 80B. However, the O-rings 87 are not essential and may be omitted as needed.

A mating-recessed part 88, in which a mating projection 89 provided on the front end of the spindle 12 at the axial center mates, is formed on a rear surface of the anvil 14 at its axial center. At the axial center of the spindle 12, an axial-center hole 90 is formed that passes from the bottomed hole 62 through to the mating projection 89, and provides (permits) communication of the bottomed hole 62 with the mating-recessed part 88, so that lubrication between the spindle 12 and the anvil 14 can be achieved by supplying grease inside the bottomed hole 62 to the mating-recessed part 88.

On the other side of the anvil 14, a front-half portion of the outer circumference of the anvil 14 constitutes a small-diameter part 91, whose diameter is smaller than that of a rear-half side of the anvil 14. An insertion hole 92, which has a regular hexagonal shape in transverse cross section and into which a bit B can be inserted in the rearward direction, is formed (extends) from the front end along the axial center of the anvil 14. In addition, a pair of radially-extending through holes 93 is formed in the anvil 14 such that the holes 93 communicate with the insertion hole 92 at point-symmetric locations around the insertion hole 92. Balls 94 are respectively held in the through holes 93. The opening of each through hole 93 on the side that communicates with the insertion hole 92 of the through hole 93 is formed smaller than the diameter of each of the balls 94 so that the balls 94 are blocked from passing completely through the through holes 93 and falling into the insertion hole 92.

A bit sleeve (operating sleeve) 95 is externally mounted on (around) the small-diameter part 91 of the anvil 14. The bit sleeve 95 is a tubular body that has a restricting ridge 96, which is adjacent to the outer circumference of the small-diameter part 91, on its rear-end inner side. The diameter of the inner circumference on the front side of the bit sleeve 95 is larger than the inner diameter of the restricting ridge 96. Furthermore, a coil spring 97 is externally mounted on (around) the small-diameter part 91 and is interposed between the restricting ridge 96 and a locking washer 99, which is positioned by a retaining ring 98 at a front-end outer circumference of the small-diameter part 91. Thereby, the bit sleeve 95 is normally biased toward a retracted position, at which the rear end of the bit sleeve 95 makes contact with a ring-shaped stopper surface 100 formed in a base outer circumference of the small-diameter part 91. At this retracted position, the restricting ridge 96 is located on the outer side of the balls 94 and restricts (blocks) radially outward movement of the balls 94, thereby holding a bit B in the insertion hole 92 owing to the engagement of the balls 94 in respective depressions formed in the shaft of the bit B, as can be seen, e.g., in FIGS. 3-4.

It is noted that, because the bearings 80A, 80B and the intermediate washer 82 are disposed radially outward of (around) the insertion hole 92, the length in the front-rear direction (i.e. the axial length of the front portion of the impact driver 1) is shorter than in an embodiment, in which the bearings 80A, 80B and the intermediate washer 82 are disposed axially rearward of the insertion hole 92.

In the impact driver 1 configured as described above, when the trigger 16 is pulled and the switch 15 is turned ON after the bit B has been mounted on the anvil 14, electric power is supplied to the motor 10, and the rotary shaft 33 rotates. That is, the microcontroller of the control circuit board 21 obtains the rotational state of the rotor 24 by acquiring the rotation-detection signals, which were output from the rotation-detection devices of the sensor circuit board 37 and indicate the positions of the sensor permanent magnets 36 of the rotor 24, controls the ON/OFF state of each switching device in accordance with the obtained rotational state, supplies electric current, in order, to each of the coils 28 of the stator 23, and thereby rotates the rotor 24.

Thereupon, the planet gears 64, which mesh with the pinion 47, revolve inside the internal gear 63 and rotate the spindle 12 at a reduced speed via the carrier 61. Thereby, the hammer 70 also rotates, the anvil 14 is rotated via the arms 81, with which the tabs engage, and it becomes possible to perform screw fastening using the bit B. At this time, because the anvil 14 is axially (and rotatably) supported by the front and rear bearings 80A, 80B, rattling of the anvil 14 is inhibited and vibration of the bit B at the tip is reduced.

As the screw fastening progresses and the torque of the anvil 14 increases, the hammer 70 retracts against the bias of the coil spring 71 while causing the balls 75 to roll along the inner-side cam grooves 74 of the spindle 12. When the tabs (not shown) become spaced apart from the arms 81, the hammer 70 rotates while advancing owing to the bias of the coil spring 71 and the guidance of the inner-side cam grooves 74, 74. Therefore, the tabs once again engage with the arms 81, 81, and the anvil 14 generates an impact force (impact) because the hammer 70 strikes (impacts) the anvil 14 in the rotational direction. It is possible to perform further screw fastenings by repeating this process.

Thus, according to the impact driver 1 of the above-described embodiment, because the anvil 14 is rotatably held by the two bearings 80A, 80B, which are of different types, the holding portion is lengthened in the front-rear direction and thus rattling of the anvil 14 can be effectively reduced. Thereby, vibration of the tip bit B can be inhibited.

In particular, because the O-rings 87, 87 are disposed on the radially inward side of the bearings 80A, 80B, the inner-side sealing properties can also be secured.

In addition, because the intermediate washer 82, which makes contact with the front and rear outer rings 80*b*, 80*b*, is disposed between the bearings 80A, 80B, it is possible to space the bearings 80A, 80B apart from one another in the front-rear direction, and thereby rattling of the anvil 14 can be more effectively reduced.

Furthermore, because the rear washer 84, which makes contact with the rear surface of the bearing 80B, is provided on the hammer case 8, the bearing 80B, which is inserted from the rear, can be positioned in a simple manner during assembly.

It is noted that a wider spacing may be secured between the front and rear bearings 80A, 80B by interposing a plurality of washers stacked in the axial direction; conversely, the bearings could be made to abut one another by eliminating the spacer(s), such as the intermediate washer(s) 82.

In addition, in the above-described embodiment, the front-side bearing is a ball bearing, and the rear-side bearing is an angular contact ball bearing; however, it would be acceptable to reverse these front and rear bearings. In addition or in the alternative, self-aligning ball bearings or other types of bearings can also be used as the bearings 80A, 80B.

Furthermore, the combinations of the bearings of differing types are not limited to the combination of the ball bearings in the above-mentioned embodiment and can be modified appropriately. Modified examples are explained below.

Figure 5:
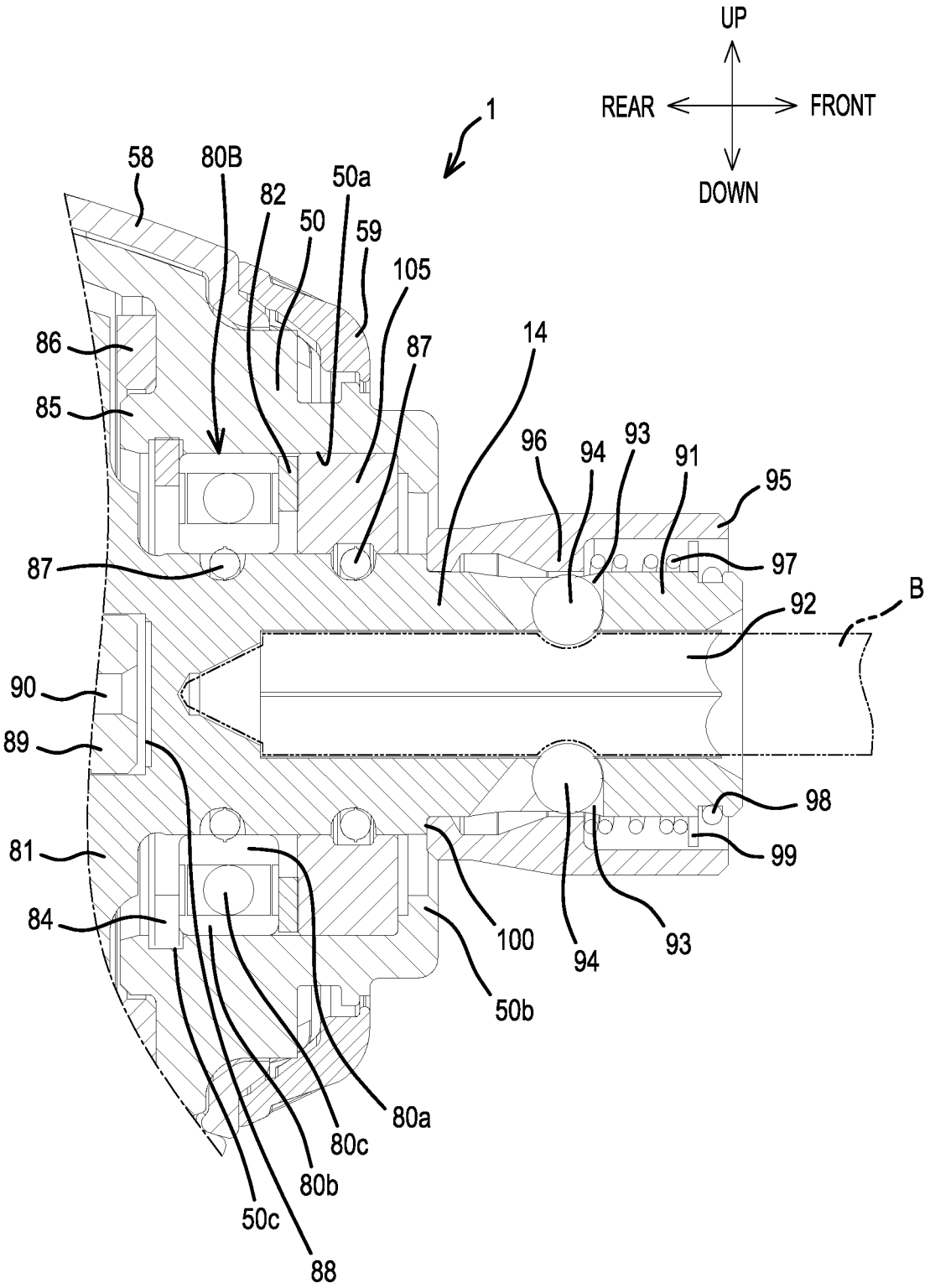
FIG. 5 is an enlarged cross-sectional view of an anvil portion, which shows a modified example of bearings as compared to the embodiment of FIG. 4.

FIG. 5 shows an example in which the front-side bearing 105 is a metal bearing (plain bushing) and the rear-side bearing 80B is a regular ball bearing. In this example as well, the bearings may be reversed front and rear. In addition or in the alternative, the ball bearing may be substituted (replaced) with an angular contact ball bearing, a self-aligning ball bearing, or the like. In addition, this example is not limited to ball bearings, and it is also possible to use roller bearings and slide bearings, such as self-aligning roller bearings, needle bearings, and oil-less bearings.

Figure 6:
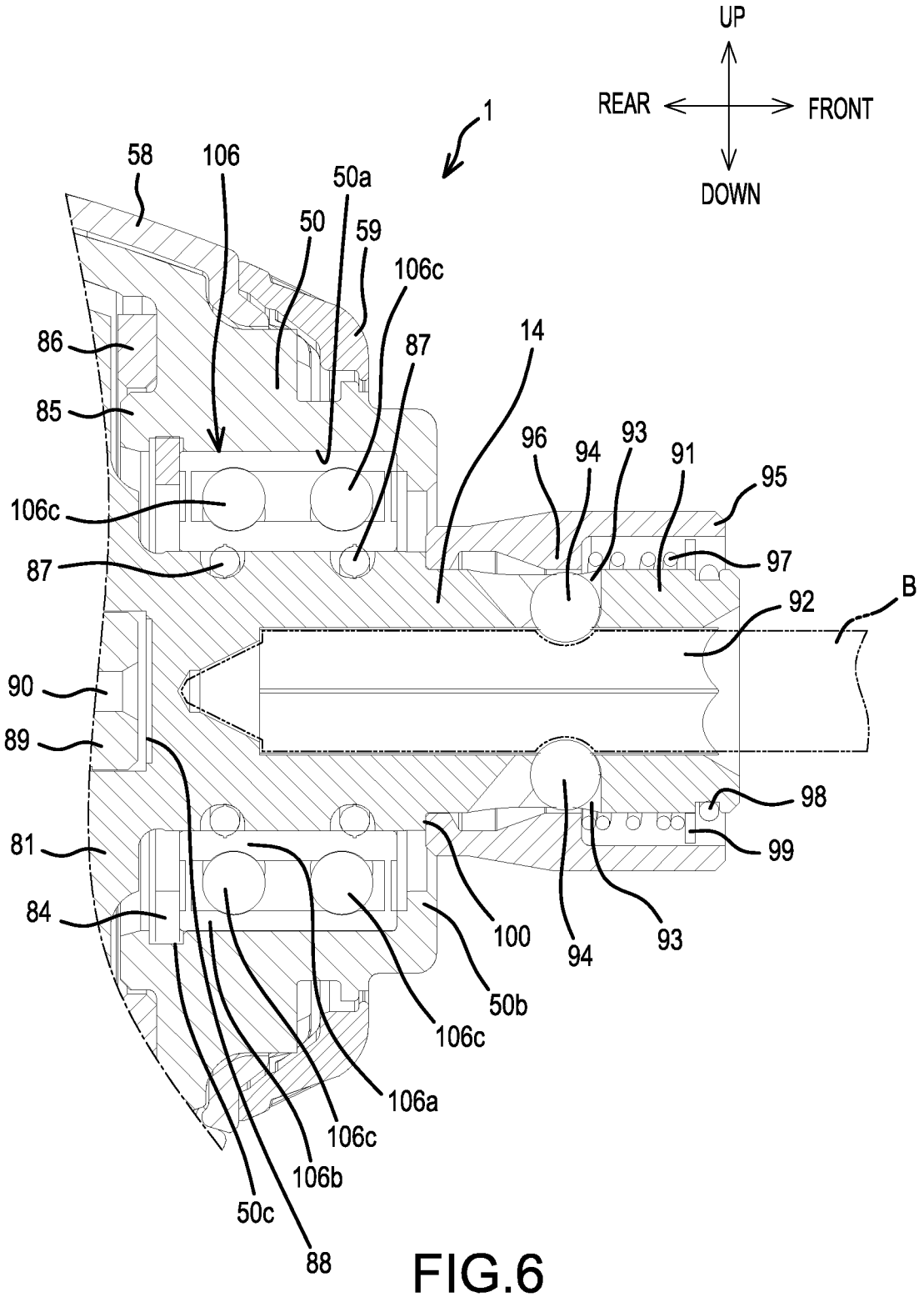
FIG. 6 is an enlarged cross-sectional view of the anvil portion, which shows another modified example of a bearing as compared to the embodiments of FIGS. 4 and 5.

FIG. 6 shows another modified example in which, unlike the ball bearings that have a plurality of balls disposed in one row between the inner ring and the outer ring as in the embodiment of FIGS. 1-4, a double-row ball bearing 106 is used that has two rows of balls 106*c*, 106*c* disposed between an inner ring 106*a* and an outer ring 106*b*, which are elongated in the front-rear direction. It is noted that it is also possible to dispose two of the double-row ball bearings 106 frontward and rearward.

Figure 7:
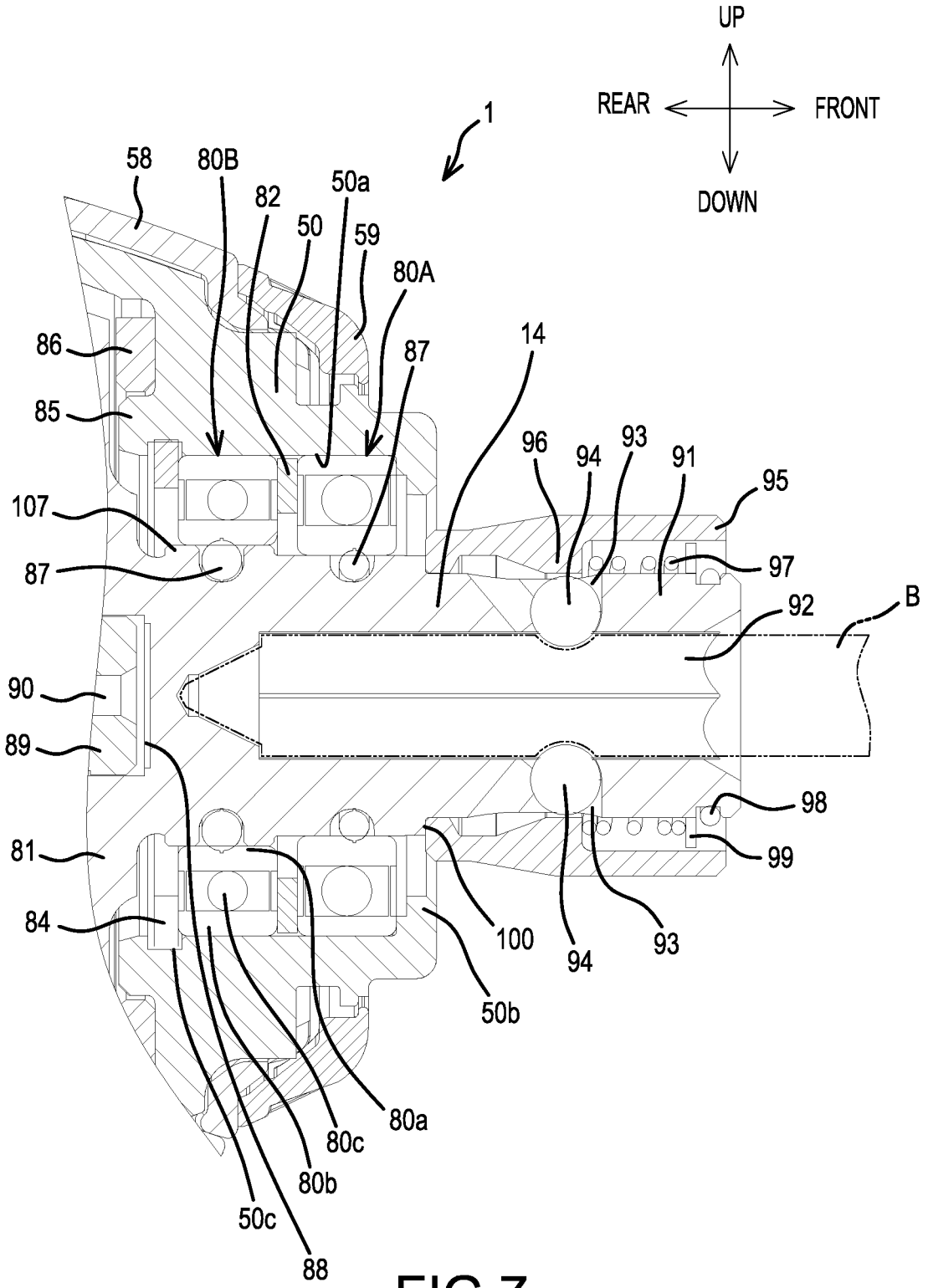
FIG. 7 is an enlarged cross-sectional view of an anvil portion, which shows yet another modified example of the bearings as compared to the embodiments of FIGS. 4-6.

In addition, in the above-described embodiment and modified examples, the inner diameters of the front and rear bearings are set equal to one another, and the outer diameters of the front and rear bearings are set equal to one another. However, for example, as shown in FIG. 7, the bearings

80A, 80B have equal outer diameters, but the inner diameter of the rear-side bearing 80B may be set larger than the inner diameter of the front-side bearing 80A. In such an embodiment, a large-diameter part 107, which has a diameter matched to the inner diameter of the rear-side bearing 80B, may be formed on the anvil 14. This arrangement of different sized inner rings may be reversed frontward and rearward. It is noted that, in FIG. 7, to equalize the interference amount with each of the inner rings 80*a*, 80*a* of the bearings 80A, 80B, whose inner diameters differ, the cross-sectional diameters of the front and rear O-rings 87, 87 are made different (i.e. the rear side O-ring 87 is larger than the front side O-ring 87).

Furthermore, it is possible to design the impact driver 1 such that the inner diameters of the front and rear bearings are equal, but the outer diameter of one of the bearings is made greater than the outer diameter of the other bearing. Of course, it is also possible to design the impact driver 1 such that both the inner diameters of the bearings as well as the outer diameters of the bearings can be made different from one another.

Thus, if the inner diameters of the front and rear bearings and/or the outer diameters of the front and rear bearings are configured to differ from each other, then a vibration-preventing effect becomes satisfactory in embodiments in which the circumferential length of the anvil 14 is long (large).

In each of the above-mentioned embodiments, a lower limit of the difference of the inner and/or outer diameters may, e.g., 5%, 10%, 15%, 20%, 25% or 30%; an upper limit of the difference of the inner and/or outer diameters may, e.g., 50%, 45%, 40%, 35%, 30% or 25%. Various ranges may be selected from these values without limitations.

Figure 8:
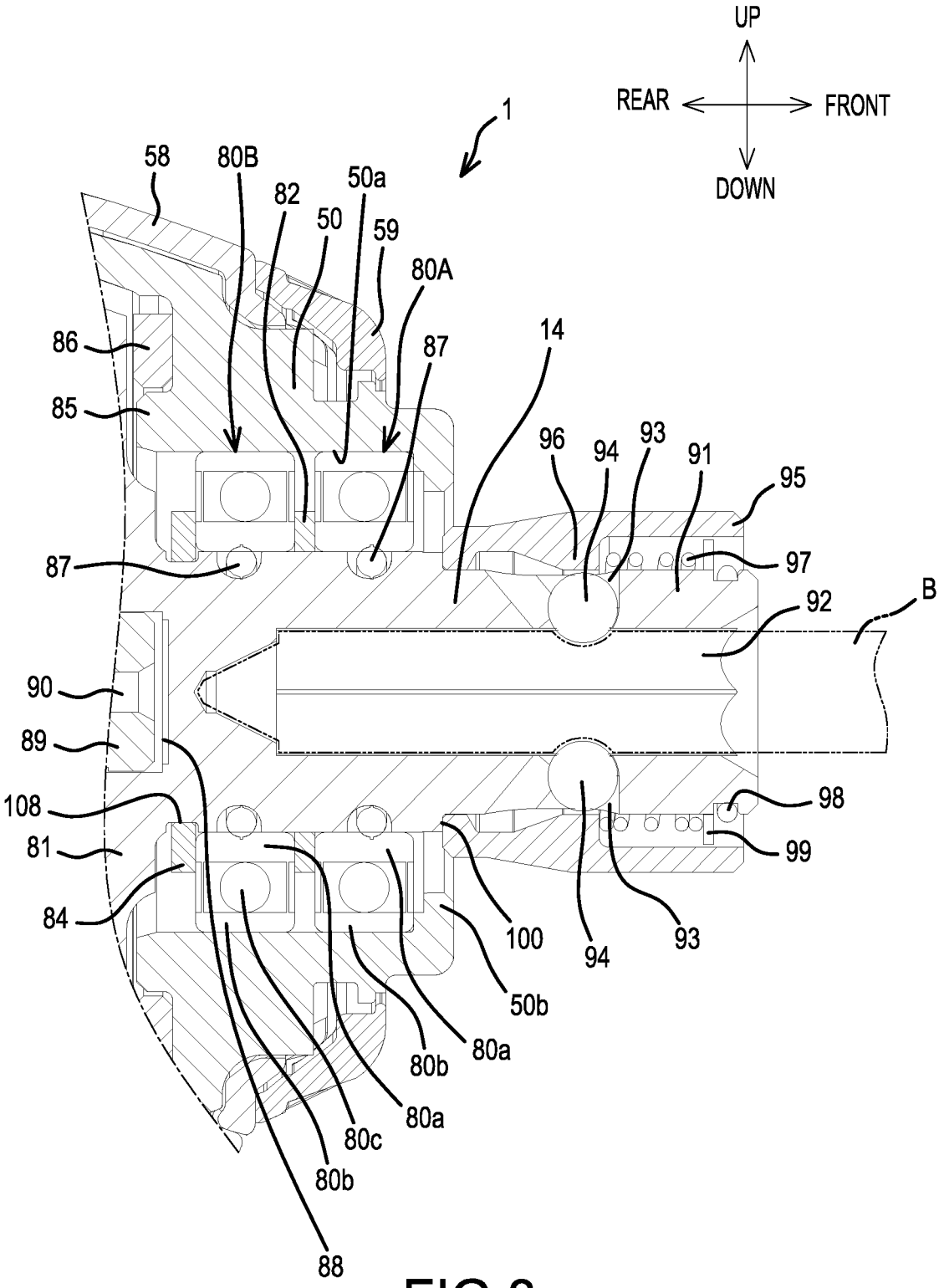
FIG. 8 is an enlarged cross-sectional view of the anvil portion, which shows a further modified example of the bearings as compared to the embodiments of FIGS. 4-7.

In the above-described embodiment and modified examples, the front and rear bearings 80A, 80B are held by the large-diameter part of the hammer case. However, reversely, for example, as shown in FIG. 8, the two bearings 80A, 80B may be held on the anvil 14 side. In this modified example, the intermediate washer 82 abuts the inner rings 80*a*, 80*a* of the bearings 80A, 80B. Furthermore, the rear washer 84 is disposed such that it mates with a groove 108, which is provided on an outer-circumferential surface of the anvil 14 and extends in the circumferential direction, and abuts the inner ring 80*a* of the bearing 80B.

In addition, in the above-described embodiment and modified examples, the number of the bearings is not limited to two, and it is also possible to provide three or more of the bearings in any of the embodiments of the present teachings.

Furthermore, the present teachings are not limited to preventing or inhibiting vibration of the bit by utilizing two or more bearings. In addition or in the alternative, it is possible, as will be described below, to prevent or inhibit vibration of the bit by suitably setting the dimension of the insertion hole 92. In the description of the following embodiment, because the structure may be basically the same as that of the impact driver 1 of the previous embodiments, except for the anvil portion, only the anvil portion, which has a different structure, is explained, and redundant explanation is omitted.

Figure 9:
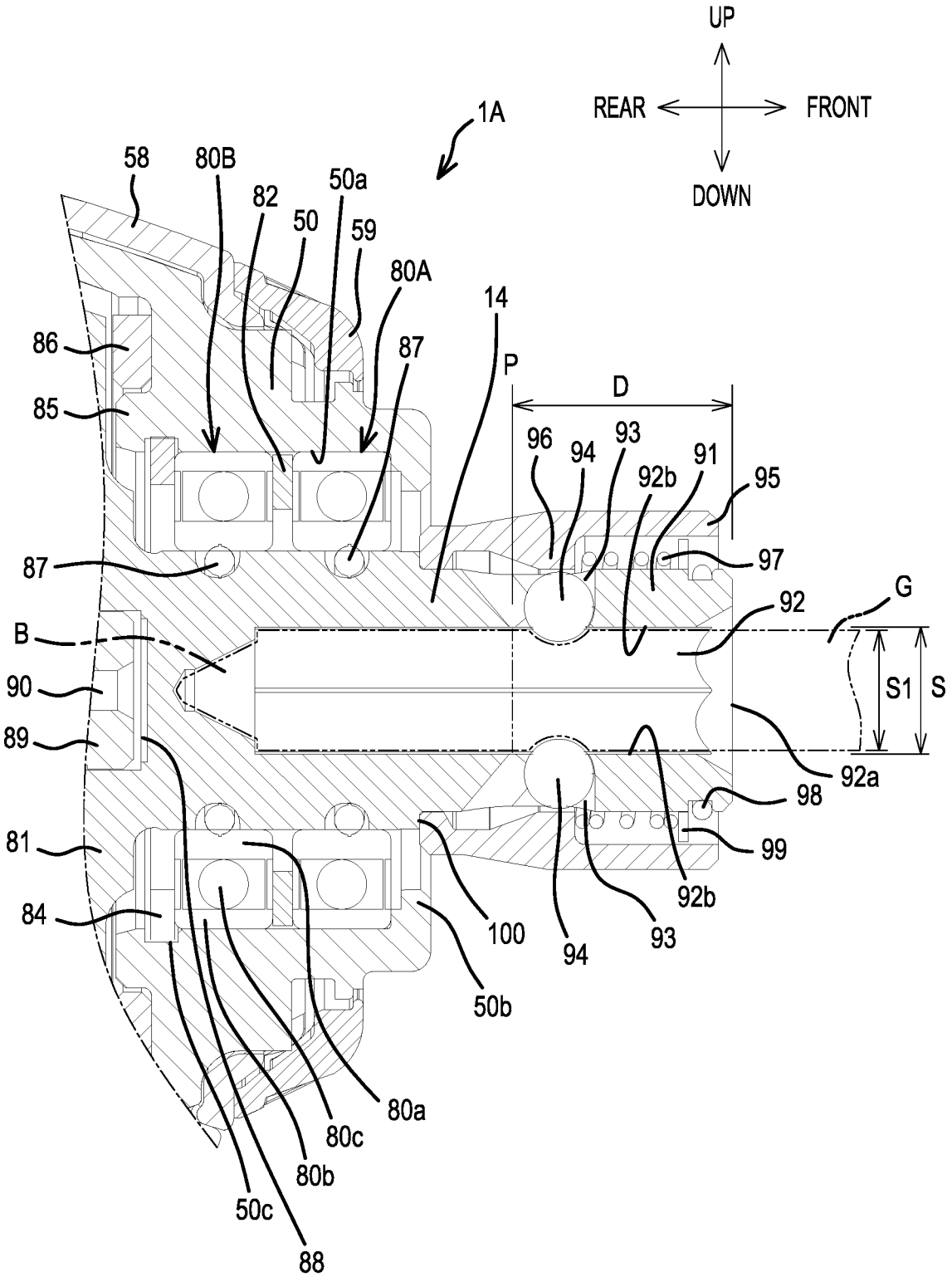
FIG. 9 is an enlarged cross-sectional view of the anvil portion of a second representative, non-limiting impact driver according to the present teachings.

Referring now to FIGS. 2 and 9, it is noted that the rearward portion of the bit B, which is to be inserted via the opening 92*a* into the insertion hole 92, has a regular hexagonal shape in transverse cross section. When fully inserted, the rear end of the bit B contacts and is held by innermost (leftwardmost) surface of the insertion hole 92. Consequently, by appropriately setting the relationship between a spacing S between mutually opposing (diametrically opposing) flats 92*b*, 92*b* of the insertion hole 92, and the across-flats-distance dimension of the bit B, rattling of the bit B in the insertion hold 92 can be inhibited during operation.

In order to investigate preferable relationships between the dimensions of the spacing S and the dimensions of the rearward portion of the bit B, multiple hex gages, which were prepared such that their across-flats-distance dimensions differed, were inserted into insertion holes of the anvils of currently commercially available impact tools manufactured by multiple companies, and the insertion states were examined. The results are shown in the table in FIG. 10. It is noted that "6.35+0.00/−0.01" of the hex gage dimension in the table indicates the situation in which a hex gage of 6.35-6.34 mm was used. This applies likewise to the other dimensions.

In FIG. 10, "fully insertable" means the state in which the hex gage was inserted fully into the insertion hole, and "not insertable beyond _mm from the opening" means the state in which the hex gage that was inserted stopped at the location _mm from the opening of the insertion hole and could not be further inserted. That is, this means that the spacing S between the flats inside the insertion hole at the stopped position is equal to the across-flats-distance dimension of the hex gage.

In addition, "not insertable into the opening" means the hex gage could not be inserted through the opening of the insertion hole.

Because the across-flats-distance dimension of the bit B, which is a standard article, was 6.35 mm, the bit of the standard article was insertable into the anvil of the impact tool for all of the companies A to G However, among these, the anvils having the narrowest spacing S between flats inside the insertion holes were the ones made by companies B and C, in which the hex gage of "6.37+0.00/−0.01" stopped at 5.5 mm from the opening.

Thereby, if the spacing S was set narrower than that, then the gap between the bit B and the spacing S became small, resulting in vibration prevention of the bit B.

Accordingly, in the impact driver 1A shown in FIG. 9, the distance D, which extends from the opening 92*a* of the insertion hole 92 toward the far side, was set to 5.4 mm, which is smaller than 5.5 mm, and the spacing S of the insertion hole 92 was set so that the bit B, in which an across-flats-distance dimension S1 was 6.35 mm, could be fully inserted into the insertion hole 92; on the other hand, the across-flats-distance dimension S1 was set such that a hex gage which was 6.37-6.36 mm, was inserted the distance D and stopped at position P. In addition, the spacing S was also set to a dimension such that the hex gage which had the across-flats-distance dimension S1 of 6.39-6.38 mm, could not be inserted.

Thereby, the gap between the insertion hole 92 and the bit B was smaller than that of existing products.

Thus, according to the impact driver 1A of the above-described second embodiment, based on the above-mentioned dimension setting of the insertion hole 92, a vibration-preventing effect was obtained in which the inserted bit B could be held without rattling while the bit B still could be inserted into the insertion hole 92.

It is noted that the distance D may be set smaller than 5.4 mm (e.g., 3.0 mm), as long as the bit B can be inserted all the way to the bottom of the insertion hole. In addition, the dimension may be set such that the hex gage G of 6.37-6.36 mm stops at a position (depth) closer than the opening 92*a* or at the opening 92*a* itself. Thus, if the distance D is set smaller than 5.4 mm, the gap between the insertion hole 92 and the bit B becomes smaller, which is effective for preventing vibration of the bit B.

Furthermore, in the impact driver 1A shown in FIG. 9 as well, although two bearings 80A, 80B are used to axially and rotatably support the anvil 14, just one bearing may be used, as long as it is possible to prevent or inhibit vibration by suitably setting the dimension of the insertion hole 92.

Bit-vibration prevention/inhibition can also be implemented by disposing a contact member, which abuts the bit B in the radial direction and/or the axial direction, rearward of the balls 94 inside the insertion hole 92. In the description of the following third embodiment, because the structure is basically the same as the impact driver 1 of the previous embodiments, except for the anvil portion, only the anvil portion, whose structure differs, will be explained, and redundant explanation is omitted.

Figure 11:
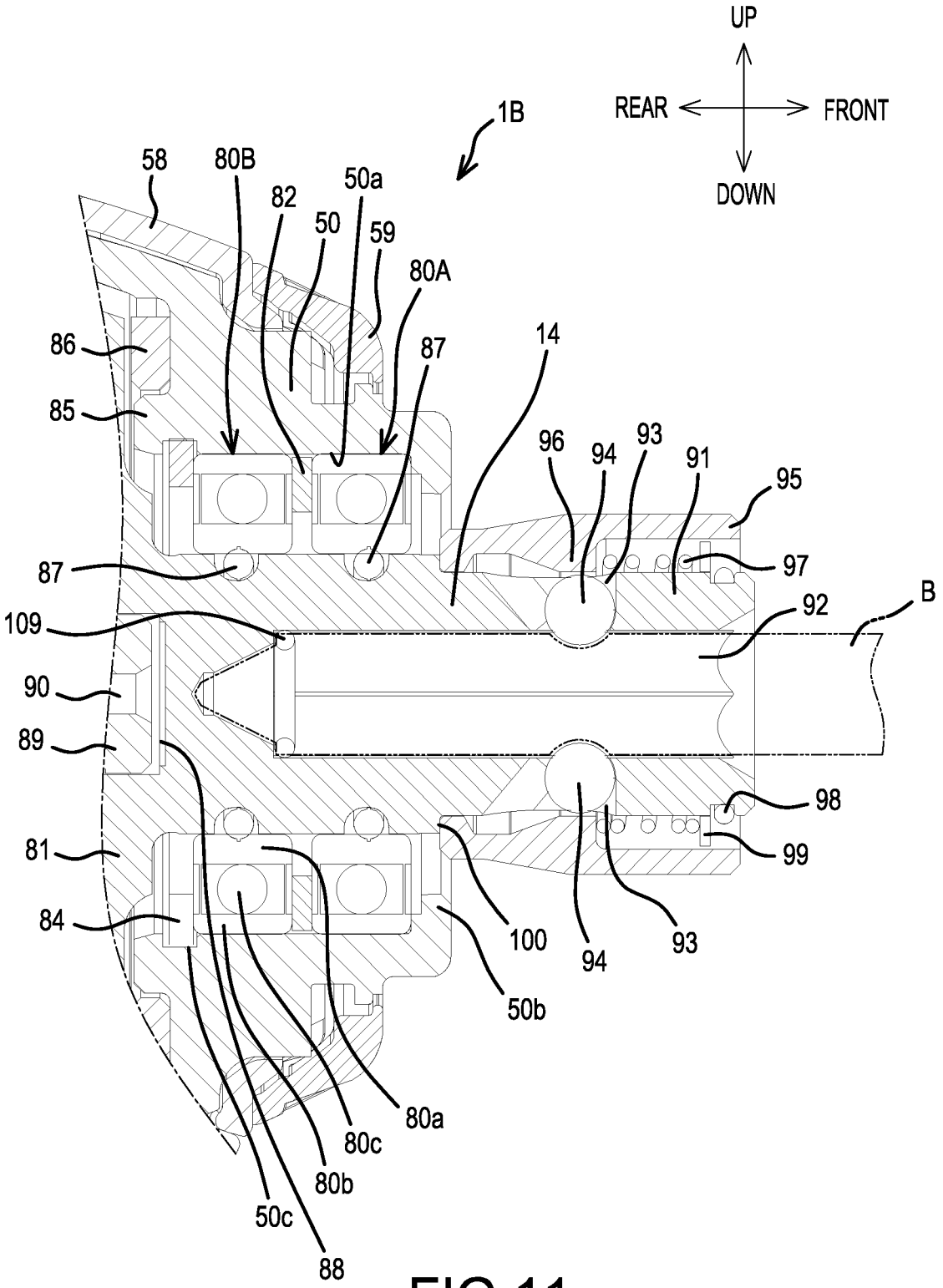
FIG. 11 is an enlarged cross-sectional view of the anvil portion of a third representative, non-limiting impact driver according to the present teachings.

In the impact driver 1B shown in FIG. 11, an O-ring 109, which serves as the contact member, is disposed rearward of the balls 94 inside the insertion hole 92. When the bit B is fully inserted, the rearward end of the bit B contacts the O-ring 109, which is thus compressed over (around) the entire circumference of the bit B. Thereby, because the rear end of the bit B is held by the O-ring 109 such that the rearward portion of the bit B does not rattle, vibration of the front-end side of the bit B also tends not to occur.

Thus, according to the impact driver 1B of the above-described embodiment, by disposing the contact member (e.g., the O-ring 109), which radially contacts the inserted bit B, on the rear side of the balls 94 inside the insertion hole 92, the inserted bit B can be held without rattling, and the vibration-preventing effect is obtained.

It is noted that the above-described embodiment may be modified such that, e.g., a plurality of the O-rings may be disposed in the axial direction, the plurality of O-rings may be disposed farther on the front side than as shown in FIG. 11, or the like. In addition, the contact member(s) is (are) not limited to an O-ring; for example, an elastic body, such as a coil spring, may be disposed at the farthermost end of the insertion hole 92 and need not make contact with the bit B in the axial direction. Furthermore, in this modified example too, the number of bearings that support the anvil 14 may be just one.

In addition, in common with the above-described embodiment and modified examples, the structure of the impact driver, other than the configurations relating to the bit-vibration prevention, can be modified as appropriate. For example, the relationship between the spindle and the mating-recessed part and mating-projection part of the anvil may be reversed, a motor other than a brushless motor, for example, a commutator motor, may be used as the motor, and the impact driver may be an AC tool in which a battery pack is not used as the power supply. In addition, the present invention is not limited to an impact driver and may be adapted to other types of impact tools such as angle impact drivers or impact wrenches.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved impact tools.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXPLANATION OF THE REFERENCE NUMBERS

1, 1A, 1B Impact driver
2 Main-body part
3 Grip part
4 Main-body housing
8 Hammer case
10 Motor
11 Planetary-gear, speed-reducing mechanism
12 Spindle
13 Impact mechanism
14 Anvil
23 Stator
24 Rotor
33 Rotary shaft
50 Front-tube part
50*a* Inner-diameter part
58 Hammer-case cover
70 Hammer
71 Coil spring
80A, 80B, 105 Bearing
80*a*, 106*a* Inner ring
80*b*, 106*b* Outer ring
80*c*, 106*c* Ball
81 Arm
82 Intermediate washer
84 Rear washer
87 O-ring
92 Insertion hole
92*a* Opening
92*b* Flat
106 Double-row ball bearing
109 O-ring
B Bit

We claim:

1. An impact tool comprising:
a motor;
a hammer that is rotated by the motor;
an anvil configured to be struck by the hammer to rotate the anvil about a rotational axis, the anvil having an outer circumferential surface;
a hammer case that houses the hammer; and
at least two hearings disposed inside the hammer case and mounted upon and around the outer circumferential surface of the anvil so as to rotatably couple the anvil with the hammer case;

wherein the beatings are of differing types and/or have differing inner diameters and/or differing outer diameters.

2. The impact tool according to claim 1, wherein the hearings have differing inner diameters and/or differing outer diameters.

3. The impact tool according to claim 2, wherein the diameters differ by more than 5%.

4. The impact tool according to claim 3, wherein the bearings are held by the hammer case.

5. The impact tool according to claim 3, wherein the hearings are held by the anvil.

6. The impact tool according to claim 1, wherein:

one of the bearings is one of a regular ball bearing, an angular contact ball bearing, a self-aligning hearing and a plain bushing; and another one of the bearings is a different one of a regular ball bearing, an angular contact ball bearing, a self-aligning bearing and a plain bushing.

7. The impact tool according to claim 6, further comprising:

an intermediate washer interposed between the regular ball bearing and the angular contact bearing.

8. The impact tool according to claim 7, wherein:

the anvil has an insertion hole having a regular hexagonal shape in transverse cross section and into which a bit (B) is inserted; and a spacing (S) between diametrically-opposing flats on an inner surface of the insertion hole is set to a dimension such that a hex gage, whose across-flats-distance dimension is 6.35-6.34 mm, is fully insertable into the insertion hole, and a hex gage, whose across-flats-distance dimension is 6.37-6.36 mm, is insertable only up to a depth that is less than 5.4 ram from the opening of the insertion hole.

9. The impact tool according to claim 8, further comprising:

a contact member disposed inside the insertion hole of the anvil and configured to radially and/or axially abut a bit inserted into the insertion hole.

10. The impact tool according to claim 1, further comprising:

a contact member disposed inside the insertion hole of the anvil and configured to radially and/or axially abut a rearward end of a bit inserted into the insertion hole.

11. The impact tool according to claim 1, further comprising:

at least one intermediate washer interposed between and directly contacting two of the bearings.

12. An impact tool comprising:

a motor;

a hammer that is rotated by the motor;

an anvil configured to be struck by the hammer to rotate the anvil about a rotational axis, the anvil having an insertion hole, which has a regular hexagonal shape in transverse cross section and into which a bit is inserted; and a hammer case that houses the hammer;

wherein a spacing (S) between diametrically-opposing flats on an inner surface of the insertion hole is set to a dimension such that a hex gage, whose across-flats-distance dimension is 6.35-6.34 mm, is fully insertable into the insertion hole, and a hex gage, whose across-flats-distance dimension is 6.37-6.36 mm, is insertable only up to a depth that is less than 5.4 mm from the opening of the insertion hole.

13. The impact tool according to claim 12, wherein the spacing (S) between the diametrically-opposing flats is set to a dimension such that a hex gage, whose across-flats-distance dimension is 6.39-6.38 mm, is not insertable through the opening of the insertion hole.

14. An impact tool comprising:

a motor;

a hammer that is rotated by the motor;

a bit;

an anvil configured to be struck by the hammer to rotate the anvil about a rotational axis, the anvil having a ball that holds the bit inside an insertion hole of the anvil, the insertion hole having a regular hexagonal shape in transverse cross section;

a hammer case that houses the hammer; and a contact member disposed inside the insertion hole rearward of the ball and abutting the inserted bit in a radial direction or an axial direction of the inserted bit.

15. The impact tool according to claim 14, wherein the contact member is an elastic body.

16. The impact tool according to claim 14, wherein the contact member is a rubber O-ring.

17. The impact tool according to claim 10, wherein the contact member is a rubber O-ring.

18. An impact tool comprising:

a motor;

a hammer that is rotated by the motor;

an anvil configured to be struck by the hammer to rotate the anvil about a rotational axis;

a hammer case that houses the hammer;

a first bearing surrounding and rotatably supporting the anvil; and a second bearing surrounding and rotatably supporting the anvil;

wherein:

the first bearing is a first one of a regular ball bearing, an angular contact ball bearing or a self-aligning bearing;

the second bearing is different one of a regular ball bearing, an angular contact ball bearing or a self-aligning bearing; and the first and the second bearings are disposed within the hammer case.

19. The impact tool according to claim 18, wherein:

the first bearing is a regular ball bearing;

the second bearing is an angular contact bearing; and at least one intermediate washer is interposed between the regular ball bearing and the angular contact bearing.

20. The impact tool according to claim 19, wherein the at least one intermediate washer directly contacts both the regular ball bearing and the angular contact bearing.

* * * * *